United States Patent [19]

Peck

[11] Patent Number: 5,070,854

[45] Date of Patent: Dec. 10, 1991

[54] BOW STRING RELEASE

[75] Inventor: Paul L. Peck, Fond du Lac, Wis.

[73] Assignee: Tru-Fire Corporation, Fond du Lac, Wis.

[21] Appl. No.: 536,426

[22] Filed: Jun. 11, 1990

[51] Int. Cl.[5] ..... F41B 5/00

[52] U.S. Cl. ..... 124/35.2; 124/31

[58] Field of Search ..... 124/23.1, 25.6, 35.1, 124/35.2, 90; 24/136 A

[56] References Cited

U.S. PATENT DOCUMENTS

| | | | |
|---|---|---|---|
| 2,637,311 | 5/1953 | Rose | 124/35.2 |
| 4,249,507 | 2/1981 | Marra | 124/35.2 |
| 4,403,594 | 9/1983 | Todd | 124/35.2 |
| 4,722,319 | 2/1988 | Brady | 124/35.2 |
| 4,860,720 | 8/1989 | Todd | 124/35.2 |
| 4,926,835 | 5/1990 | Peck | 124/35.2 |
| 4,930,485 | 6/1990 | Kopper | 124/35.2 X |
| 4,949,698 | 8/1990 | Burnham | 124/35.2 |

*Primary Examiner*—Peter M. Cuomo
*Assistant Examiner*—Jeffrey L. Thompson
*Attorney, Agent, or Firm*—Andrus, Sceales, Starke & Sawall

[57] ABSTRACT

A bow string release includes elongate, cylindrical sears adapted for linear, axial movement into and out of a string retaining notch, the sears having ends which for a string centering retainer when in the closed, string retaining position. The latch system is designed to engage the sears below their center lines to minimize trigger travel. A trigger with a cam actuator is provided to further minimize trigger travel.

13 Claims, 2 Drawing Sheets

FIG. 1
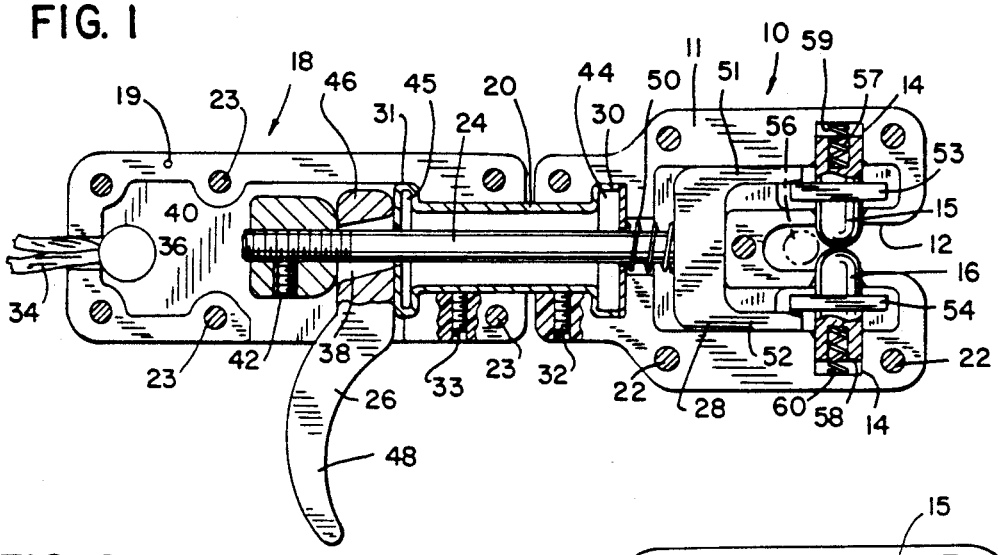
FIG. 2
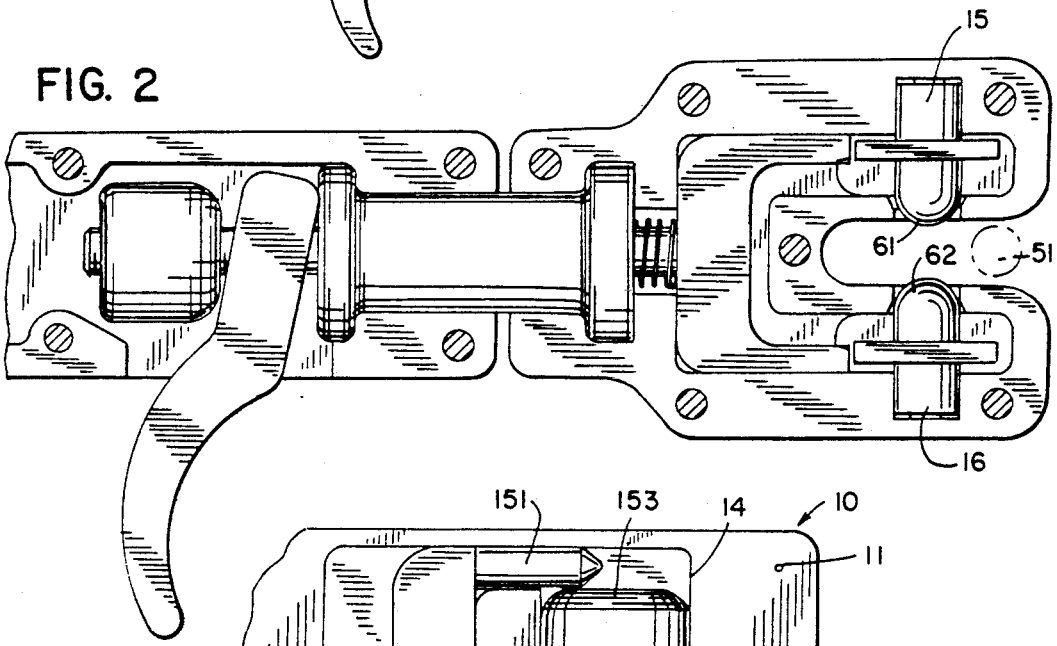
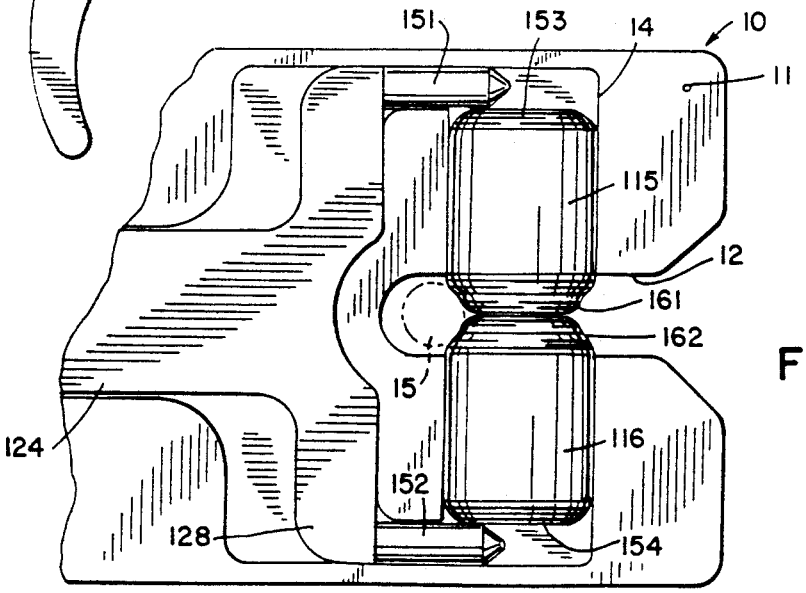
FIG. 3

BOW STRING RELEASE

BACKGROUND OF THE INVENTION

This invention relates to bow string releases of the type having a releasable sear for retaining a bow string, the sear including a pair of elements adapted for linear movement into and out of a closed position to retain the bow string. Related applications filed by the same inventor are Ser. No. 07/518,957 filed on May 4, 1990 and Ser. No. 07/535,892 filed on even date herewith.

Bow string releases have grown in popularity for target shooting and for hunting. A good release provides uniform release of the bow string and increases accuracy. The release is either hand-held or strapped to the wrist and has a trigger which permits the archer to release the string. Typically such devices employ a pivotal finger that engages the bow string, the finger being pivoted to a release position for releasing the string. Releases of this type are illustrated in U.S. Pat. Nos. 4,066,060; 3,898,974; and 3,954,095. It is known to use ball elements in place of the pivotal finger to retain and release the string, wherein the ball elements are held by a head and retained in position by a yoke or sleeve. A device of this type is illustrated in U.S. Pat. No. 4,403,594. While it is recognized that when the balls are separated by the tension of the string this provides minimal frictional engagement and a quiet release. Further, the balls do not produce a lateral bias on the string. However, this type of release has a significant disadvantage in that the amount of movement required to release the string is excessive when compared to the more common pivotal releases.

SUMMARY OF THE INVENTION

The bow string release of the present invention provides linear traveling sear elements which permit minimum movement of the latch to release the string. In addition, one embodiment of the invention provides a string retaining structure which conforms to the shape of the string, thereby reducing deformation and stress on the bow string when it is held by the release. This design takes advantage of the superior features of linear travel sear mechanisms while retaining the advantages of short stroke trigger releases such as the pivotal latches shown in the aforementioned application. In particular, the present invention includes an elongate, cylindrical sear mounted in the release head for linear or axial travel into and out of a string retaining notch. The cylindrical structure permits a latch yoke to engage and hold the sear below its center line, thus reducing the amount of travel required of the yoke in order to release the sear elements and the string. This permits the trigger to have a travel and a "feel" similar to that of pivotable bow string releases while taking advantage of the features of linear motion sear elements.

An additional feature of the invention is the cam trigger release, which provides a mechanical advantage over known pivotal lever releases. By employing a cam actuator on the trigger, a controlled travel ratio can be achieved between trigger travel and latch travel. This further reduces the amount of trigger travel required to release the bow string. It will be understood that this feature of the invention can be utilized in any number of bow release designs and is not limited to a release combined with the other features of the present invention.

These and other advantages will be more readily understood by reference to the drawings and detailed description which follow.

BRIEF DESCRIPTION OF THE DRAWINGS

FIG. 1 illustrates the bow string release of the present invention, with the covers removed and the sear elements in the closed position.

FIG. 2 is an enlarged view of the release of FIG. 1, with the sear elements in the opened position.

FIG. 3 is an enlarged fragmentary view of a release, looking in the same direction as FIG. 2, showing alternate sear elements.

DETAILED DESCRIPTION OF THE INVENTION

Figure 4:
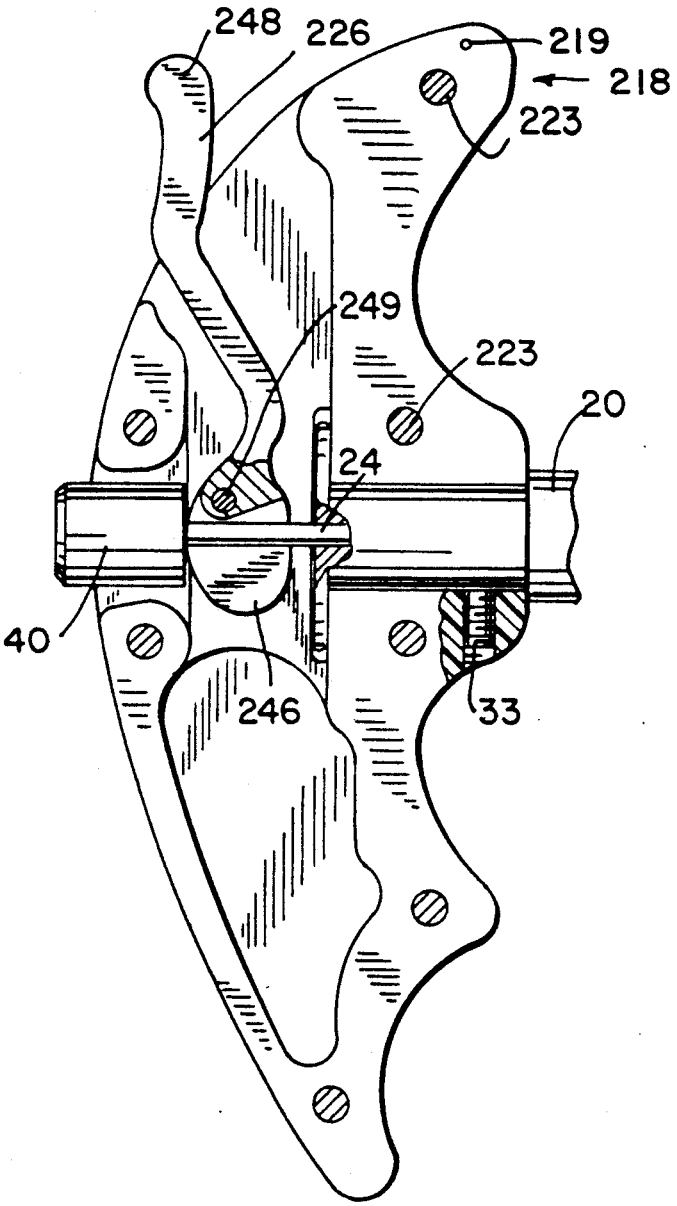
FIG. 4 is a fragmentary view of a release, looking in the same direction as FIG. 2, showing an alternate trigger release mechanism.

As shown in FIG. 1, the bow string release includes a head 10 including a string retaining notch 12 and a sear receiving channel 14 for slidably receiving and retaining a pair of sear elements 15 and 16.

The release body 18 is rotatably mounted relative to the head 10 on shaft 20. In the illustrated configuration, the head 10 and body 18 each may comprise a unitary molded base 11 and 19, respectively, each with suitable recesses and cavities to receive the various internal elements of the release. A molded cover, removed for clarity, is secured to each respective base at posts 22, 23 to maintain the release in its assembled state.

As shown, the shaft 20 is hollow to receive pin 24 for communicating the trigger 26 in the body and the latch yoke 28 in the head. The shaft includes enlarged ends 30, 31, received by suitable cavities in the head and body, respectively, for securing the head and body to the shaft when the covers are mounted on their respective bases. Both the head and body are rotatable about the shaft so that the sear elements and trigger may be oriented relative to one another to accommodate the individual needs of each user. Set screws 32, 33 are provided to lock the head relative to the body in the desired setting. The body 18 can be of any desired configuration such as the palm-type shown in FIG. 1 with a suitable wrist strap 34 held in place between the base and cover by retainer 36, or the hand-held thumb-release, as shown in FIG. 4.

The trigger 26 is pivotally carried in the head and includes a through hole 38 for receiving the pin 24. An adjustable stop-knob 40 is provided on the threaded end of the pin and may be adjusted relative to the trigger to fine-tune the travel stroke required to release the sear elements. A set screw 42 is provided to maintain the knob 40 in position. Bearing surfaces such as washers 44 and 45 are provided in the enlarged ends 30, 31 of the shaft 20 to slidably carry the pin 24. The actuator end 46 of the trigger is carried between shaft end 31 and knob 40, whereby movement of the trigger finger 48 to the left (as shown) pulls the pin 24 and yoke 28 to release the sear elements 15, 16 (see FIG. 2). A compression spring 50 may be provided between spool end 30 and yoke 28 to normally bias and urge the pin, yoke and trigger into the closed position (FIG. 1).

As particularly shown in FIGS. 1 and 2, the latch mechanism comprises a yoke 28 which is a generally "U" shaped member termating in a pair of legs 51 and 52 in communication with the sear elements 15 and 16, respectively. The pin 24 is connected to the base of the yoke. The sear elements 15 and 16 each include a raised, annular ring 53 and 54, respectively, located intermediate the ends of the sear element and adapted to receive and engage the respective leg of the yoke. This structure permits minimum contact between the yoke legs 51, 51 and the rings 53, 54 allowing for minimum travel of the yoke in order to release the sear elements 15 and 16. When the trigger 26 is pulled, moving the pin and yoke against spring 50, the legs 51 and 52 release rings 53, 54 and the tension on the bow string 56 (in phantom) separates the sear elements to release the string, as shown in FIG. 2.

A hollow cavity 57, 58 is provided in each sear 15, 16 for receiving a compression spring 59, 60, normally biasing and urging the sear elements into the closed position, permitting the sear elements, yoke, pin, and trigger to return to the closed position once the string is released. In order to reload, the trigger is pulled to release the sears and the string is reinserted in the notch, afterwhich release of the trigger returns the various moving elements to the locked, string retaining position.

When closed, the two outer ends 61, 62 of the sears 15, 16 are in abutting relationship to retain the string in the notch 12. As shown in FIGS. 1 and 2, the abutting ends may be spherical in shape to provide a string retaining "V" similar to that of known ball-type releases.

An alternative is illustrated in FIG. 3, where the abutting ends of the sear elements 115, 116 are concave tapered surfaces 161, 126, respectively, conforming generally to the periphery of the string 56 when in the abutting, closed position. This reduces deformation and fatigue of the string when it is retained in the release. As shown in FIG. 3, the pin 124 and yoke 128 are an integral member with cylindrical legs 151, 152 extending therefrom to contact and engage the elongate, cylindrical sear elements 115, 116. Each sear element 115, 116 includes a tapered or rounded end portion 153, 154 to receive the legs 151, 152, respectively. A conical point 155, 156 is provided on each yoke leg 151, 152. By properly mating the taper or radius 153, 154 with the point 151, 152, the sear elements are self-locking without the aid of a sear spring (as shown at 59 and 60 of FIG. 1). The return of pin 124 and yoke 128 to the closed position will permit tapers 153 and 154 to ride on points 151 and 152, returning the sear elements to the closed position. As in the embodiment of FIG. 1, the sear elements of FIG. 3 can be engaged at a point below their center line axis to reduce travel required to the latch yoke and trigger.

The trigger stroke can be further modified by using the trigger arrangement illustrated in FIG. 4. As there shown, the body 218 comprises a hand grip made up of a base 219 and a cover (now shown) which is suitably secured on posts 223. The body is mounted for rotation on shaft 20, as previously described, and includes a set screw 33 to maintain it in proper orientation to the head. The pin 24 is carried, as before, in the hollow shaft 20 and includes a stop knob 40 at its outer end. The trigger 226 includes a thumb lever 248 and an eccentric cam actuator 246. The trigger is mounted for pivotal motion at post 249, with the cam surface 246 in contact with the stop 40 of the pin 24. By using the cam actuator surface, a mechanical advantage is provided where the movement is translated to pin 24 by movement of lever 248. The shape of the cam surface can be designed to provide any desired trigger stroke and force to release the bow string, regardless of the length of latch travel required and regardless of the length of the trigger lever.

While certain embodiments and features of the invention are described herein, it will be understood that the invention encompasses all embodiments and modifications within the scope and spirit of the following claims.

What is claimed is:

1. A bow string release of the type having a head including a notch for receiving a bow string, a sear mechanism in the notch and selectively movable between a closed, string retaining position and an open, string releasing position, a body attached to the head and including a trigger and a latch mechanism communicating the trigger with the sear mechanism and responsive to movement of the trigger to release the sear mechanism from the closed position to the open position, the release further comprising:

a. a channel in the head substantially perpendicular to the notch for receiving the sear mechanism;

b. the sear mechanism including a pair of elongate cylindrical members slidably received in the channel on opposite sides of the notch and movable between an abutting, closed position and a separated open position; and c. the latch mechanism including a sear engaging member movable between a sear closing position and a sear opening position in response to movement of the trigger.

2. The release of claim 1, the sear engaging member further comprising an elongate finger engaging each cylindrical sear at a point below its axial center line.

3. The release of claim 2, each cylindrical sear element including a rounded end portion at its end outboard of said notch, for receiving and engaging the respective finger.

4. The release of claim 3, wherein each finger is tapered to mate at its end point to slidably engage the rounded end of the respective cylindrical sear element.

5. The release of claim 2, each cylindrical sear element including an annular ring projecting radially outward from the sear for engaging the respective finger.

6. The release of claim 2, the latch mechanism including a yoke slidably mounted in the head and movable in a direction substantially perpendicular to the channel for selectively engaging and releasing the sear elements, said fingers extending from opposite ends of the yoke.

7. The release of claim 1, each cylindrical sear element including a spherical end portion for defining a string engaging and centering recess when the sear elements are in the abutting, closed position.

8. The release of claim 1, each cylindrical sear element including a contoured, tapered end portion for defining a string engaging and centering recess substantially conforming to the circumferential shape of the string when the sear elements are in the abutting, closed position.

9. The release of claim 1, further including biasing means in the head and engaging the sear mechanism for normally biasing it into the closed position.

10. The release of claim 9, each cylindrical sear element including a cavity in one end, said biasing means comprising a compression spring seated in said cavity and engaging said head.

11. The bow string release of claim 1, wherein the latch mechanism includes an elongate member extending from the body to the head and axially movable into and out of engagement with the sear mechanism, the trigger pivotally mounted in the body and engaging said elongate member, whereby pivotal movement of the trigger is translated into axial movement of the latch mechanism.

12. The bow string release of claim 11, the latch mechanism further including a radial stop member extending outwardly from the elongate member, the trigger comprising a release lever and a cam, said trigger being pivotally mounted in the body at a point intermediate of the lever and the cam, wherein the cam is in engagement with the stop member to translate movement of the lever to the latch mechanism.

13. A bow string release of the type having a head including a notch for receiving a bow string, a sear mechanism slideably mounted in the head and selectively movable between a closed, string retaining position and an open, string releasing position, a body attached to the head and including a trigger, and latch mechanism communicating the trigger with a sear mechanism and responsive to movement of the trigger to release the sear from the closed position to the open position, the release further comprising:

a. the sear mechanism including a pair of elongate cylindrical sears each having a cylindrical axis and an outer cylindrical wall and mounted for axial movement into and out of said notch, between a closed, abutting string retaining position and a separated, string releasing position, and b. the latch mechanism including means in communication with each sear and adapted for engaging each of said sears between the cylindrical axis and the outer cylindrical wall thereof, whereby less than one half of the radius of each sear is in engagement with the latch mechanism, the latch mechanism adapted for maintaining the sears in the closed position when in the sear engaging position and movable to a non-engaging position to release each of said sears to the open position.

* * * * *